US011828506B2

(12) United States Patent
Sakthivel et al.

(10) Patent No.: US 11,828,506 B2
(45) Date of Patent: Nov. 28, 2023

(54) HOT GAS DEFROST USING DEDICATED LOW TEMPERATURE COMPRESSOR DISCHARGE

(71) Applicant: Heatcraft Refrigeration Products LLC, Stone Mountain, GA (US)

(72) Inventors: Saravana Vaithilingam Sakthivel, Chennai (IN); Karthick Kuppusamy, Salem (IN)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 159 days.

(21) Appl. No.: 17/466,017

(22) Filed: Sep. 3, 2021

(65) Prior Publication Data

US 2023/0070186 A1 Mar. 9, 2023

(51) Int. Cl.
*F25B 47/02* (2006.01)
*F25B 41/22* (2021.01)

(52) U.S. Cl.
CPC ..... *F25B 47/022* (2013.01); *F25B 41/22* (2021.01); *F25B 2400/23* (2013.01)

(58) Field of Classification Search
CPC .. F25B 4/02; F25B 4/022; F25B 41/22; F25B 2400/16; F25B 2400/23; F25B 2400/051; F25B 2600/2523
See application file for complete search history.

(56) References Cited

U.S. PATENT DOCUMENTS 4,012,921 A 3/1977 Willitts et al.
4,945,733 A 8/1990 Labrecque
9,377,236 B2 * 6/2016 Hinde ..... F25D 21/06
10,782,055 B2 * 9/2020 Zha ..... F25B 5/00
10,895,411 B2 * 1/2021 Zha ..... F25B 41/39
10,962,266 B2 * 3/2021 Zha ..... F25B 47/022
11,656,009 B2 * 5/2023 Zha ..... F25B 49/02 62/84
2012/0011866 A1 * 1/2012 Scarcella ..... F25B 41/39 62/79
2015/0345835 A1 * 12/2015 Martin ..... F25B 15/06 62/238.3
2019/0360730 A1 * 11/2019 Hagh ..... F25B 41/39
2020/0132348 A1 * 4/2020 Zha ..... F25B 49/02
2020/0132351 A1 * 4/2020 Zha ..... F25B 1/10

FOREIGN PATENT DOCUMENTS

DE 10233411 B4 9/2013
EP 1498673 B1 8/2013
EP 3643987 A1 4/2020
EP 3657098 A1 5/2020
FR 2933482 A3 1/2010
WO 2011054397 A1 5/2011
WO 2013078088 A1 5/2013

OTHER PUBLICATIONS

Sakthivel, S. V. et al., "Hot Gas Defrost Using Medium Temperature Compressor Discharge," U.S. Appl. No. 17/466,065, filed Sep. 3, 2021, 33 pages.
Extended European Search Report, Application No. 22189131.0, dated Jan. 23, 2023.

* cited by examiner

*Primary Examiner* — Miguel A Diaz
(74) *Attorney, Agent, or Firm* — Baker Botts L.L.P.

(57) ABSTRACT

A refrigeration system includes a dedicated defrost-mode compressor that delivers high pressure, high temperature refrigerant to one or more evaporators to defrost the evaporators.

18 Claims, 4 Drawing Sheets

HOT GAS DEFROST USING DEDICATED LOW TEMPERATURE COMPRESSOR DISCHARGE

TECHNICAL FIELD

This disclosure relates generally to refrigeration systems and methods of their use. More particularly, in certain embodiments, this disclosure relates to hot gas defrost using dedicated low temperature compressor discharge.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY OF THE DISCLOSURE

During operation of refrigeration systems, ice may build up on evaporators. These evaporators need to be defrosted to remove ice buildup and prevent loss of performance. Previous evaporator defrost processes are limited in terms of their efficiency and effectiveness. For example, using previous technology, defrost processes may take a relatively long time and consume a relatively large amount of energy. In some cases, previous technology may be incapable of providing adequate defrosting, for instance, in cases where a relatively large number of evaporators need to be defrosted in a multiple-evaporator refrigeration system.

This disclosure provides technical solutions to the problems of previous technology, including those described above. For example, a refrigeration system is described that facilitates improved evaporator defrost using a dedicated defrost-mode compressor. The dedicated defrost-mode compressor may operate at a higher suction pressure and discharge pressures than typical low temperature compressors in order to further improve defrost performance. A corresponding dedicated suction and discharge line facilitate flow of appropriately warmed and compressed refrigerant to one or more evaporators during defrost mode operation. In some embodiments, a pressure switch in the discharge line may ensure an excessive pressure is not provided during defrost, thereby preventing damage to evaporators being defrosted. When operating to provide defrost to one or more evaporators, the dedicated defrost-mode compressor is supplied with superheated gas generated by a heat exchanger and expansion valve that are located downstream of the system's gas cooler. In some case, evaporators of the refrigeration system may be specially configured to have to operate at increased pressures to facilitate this new defrost process.

Embodiments of this disclosure may provide improved defrost operations to evaporators of refrigeration systems, such as $CO_2$ transcritical refrigeration systems. The system is configured to provide an increased pressure differential to drive refrigerant flow in defrost mode operation. While one or a portion of the evaporators of the refrigeration system are operating, low-temperature compressors used for refrigeration can still operate as usual without requiring increased pressure operation and without unnecessarily increasing power consumption. The heat exchanger of the refrigeration system not only facilitates the improved defrost process but also lowers power consumption during refrigeration by further cooling refrigerant from the gas cooler. As such, the refrigeration system of this disclosure provides improved defrost operations while also improving the energy efficiency of the refrigeration system. Certain embodiments may include none, some, or all of the above technical advantages. One or more other technical advantages may be readily apparent to one skilled in the art from the figures, descriptions, and claims included herein.

In an embodiment, a refrigeration system includes a gas cooler, a heat exchanger located downstream from the gas cooler, a flash tank located downstream a first outlet of the heat exchanger (e.g., downstream a high pressure expansion valve (HPEV)), a defrost-mode compressor located downstream a second outlet of the heat exchanger, a first evaporator unit located downstream from the flash tank, and a controller communicatively coupled to the defrost-mode compressor. The flash tank is configured to store refrigerant. The gas cooler is configured to receive high pressure, high temperature refrigerant and facilitate heat transfer from the received refrigerant to ambient air, thereby cooling the refrigerant. The controller is configured to determine when the first evaporator unit needs to be defrosted. (i.e., that operation of the first evaporator unit in a defrost mode is indicated). After determining that the first evaporator unit needs to be defrosted, in the defrost mode is indicated, the controller causes the first evaporator unit to operate in the defrost mode by causing the defrost-mode compressor to turn on. When the defrost-mode compressor is turned on, the heat exchanger is configured to receive a portion of refrigerant stored by the flash tank and transfer heat to the received portion of refrigerant from the refrigerant cooled by the gas cooler, thereby heating the received portion of refrigerant. The defrost-mode compressor is configured, while turned on, to compress this heated refrigerant to high pressure and deliver to the first evaporator unit, thereby defrosting an evaporator of the first evaporator unit.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1-4 of the drawings, like numerals being used for like and corresponding parts of the various drawings.

As described above, prior to this disclosure, defrost operations of refrigeration systems suffered from certain inefficiencies and drawbacks. The refrigeration system of this disclosure provides improvements in defrost performance and energy efficiency. In some cases, the refrigeration system may ensure that all appropriate defrost operations can be performed when needed, while previous technology may have been limited in the number of evaporators that could be defrosted at a given time or over a given period of time.

The refrigeration system of this disclosure may be a $CO_2$ transcritical refrigeration system. $CO_2$ transcritical refrigeration systems differ from conventional refrigeration systems in that transcritical systems circulate refrigerant that becomes a supercritical fluid (i.e., where distinct liquid and gas phases are not present) above the critical point. As an example, the critical point for carbon dioxide ($CO_2$) is 31° C. and 73.8 MPa, and above this point, $CO_2$ becomes a homogenous mixture of vapor and liquid that is called a supercritical fluid. This unique characteristic of transcritical refrigerants is associated with certain operational differences between transcritical and conventional refrigeration systems. For example, transcritical refrigerants are typically associated with discharge temperatures that are higher than their critical temperatures and discharge pressures that are higher than their critical pressures. When a transcritical refrigerant is at or above its critical temperature and/or pressure, the refrigerant may become a "supercritical fluid"—a homogenous mixture of gas and liquid. Supercritical fluid does not undergo phase change process (vapor to liquid) in a gas cooler as occurs in a condenser of a conventional refrigeration system circulating traditional refrigerant. Rather, supercritical fluid cools down to a lower temperature in the gas cooler. Stated differently, the gas cooler in a $CO_2$ transcritical refrigeration system receives and cools supercritical fluid and the transcritical refrigerant undergoes a partial state change from gas to liquid as it is discharged from an expansion valve.

Refrigeration System

Figure 1:
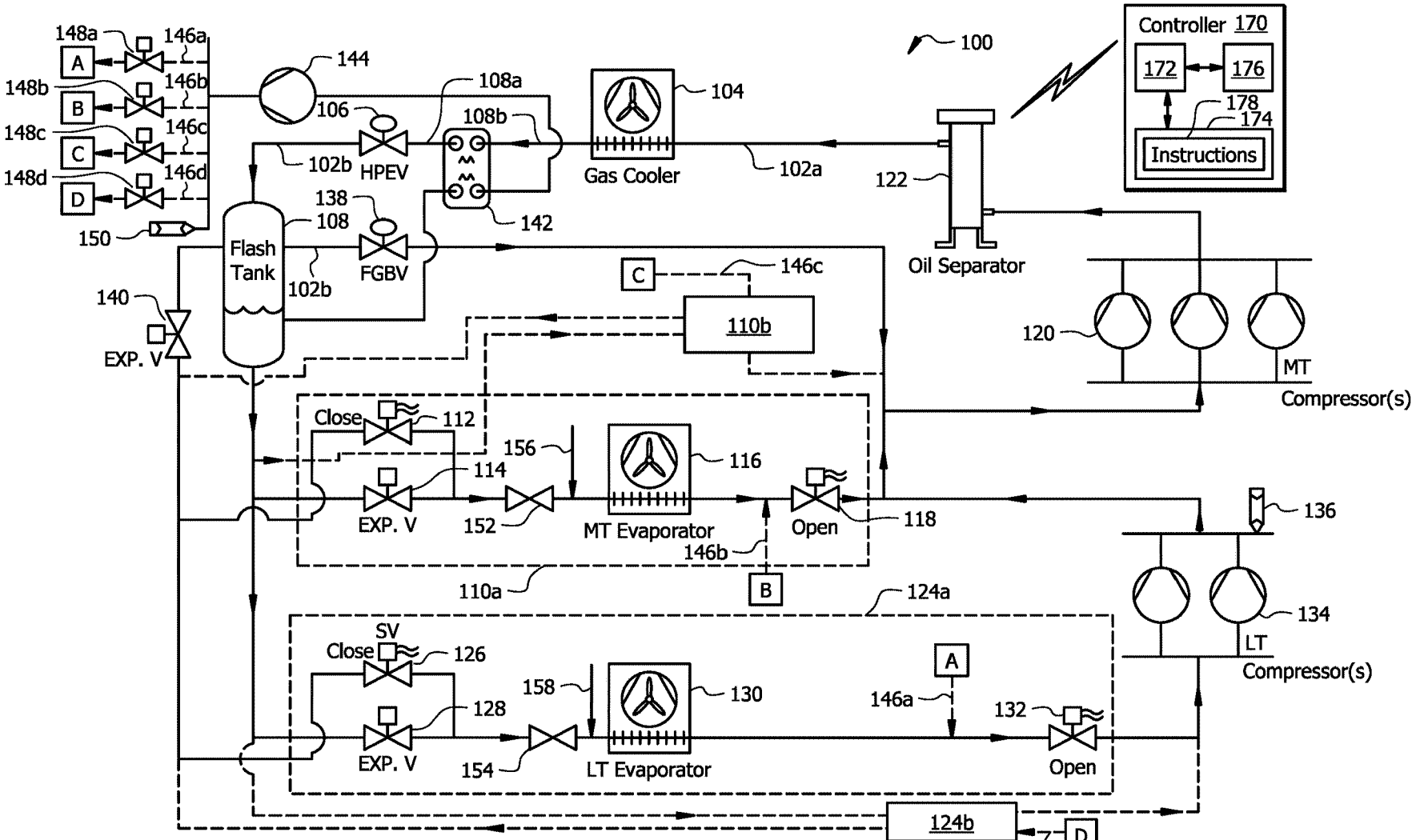
FIG. 1 is a diagram of an example refrigeration system with a dedicated defrost-mode compressor configured to operate the evaporator units in a refrigeration mode.
Figure 2:
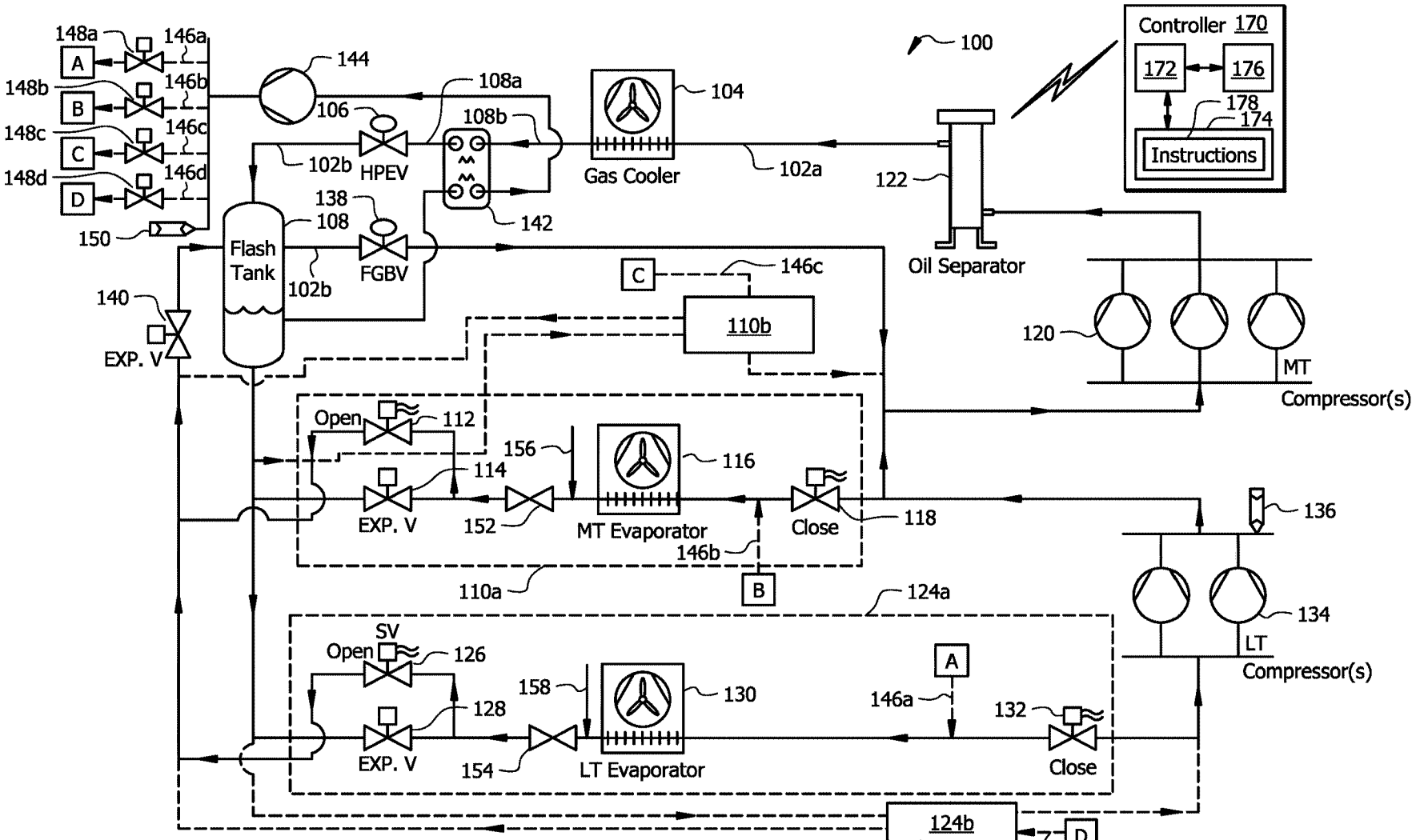
FIG. 2 is a diagram of the refrigeration system of FIG. 1 configured to operate a low temperature and medium temperature evaporator unit in defrost mode.

FIGS. 1 and 2 illustrate an example refrigeration system 100 configured for improved defrost operation. The refrigeration system 100 shown in FIG. 1 is configured to operate evaporator units 110*a,b*, 124*a,b* in the refrigeration mode, such that the evaporators 116, 130 provide cooling to a corresponding space, such as a freezer and deep freeze, respectively (not shown for clarity and conciseness). FIG. 2 illustrates the example refrigeration system 100 when configured for operation of evaporator units 110*a*, 124*a* in a defrost mode, such that evaporators 116, 130 are defrosted. When at least one of the evaporator units 110*a,b*, 124*a,b* is operated in defrost mode, refrigerant from the flash tank 108 is heated by a heat exchanger 142 downstream of gas cooler 104. A dedicated defrost-mode compressor 144 pumps this heated refrigerant to the evaporator(s) 116, 130 of the evaporator unit(s) 110*a*, 124*a* operating in defrost mode. The refrigerant provided by the defrost-mode compressor 144 removes ice buildup from coils of the evaporator(s) 116, 130.

Refrigeration system 100 includes refrigerant conduit subsystem 102, gas cooler 104, heat exchanger 142, expansion valve 106, flash tank 108, one or more medium-temperature (MT) evaporator units 110*a,b*, one or more MT compressors 120, an oil separator 122, one or more low-temperature (LT) evaporator units 124*a,b*, one or more LT compressors 134, pressure-relief valves 136, 150, a bypass valve 138, an expansion valve 140, a defrost-mode compressor 144, refrigerant conduit 146*a-d*, optionally valves 148*a-d*, and controller 170. In some embodiments, refrigeration system 100 is a transcritical refrigeration system that circulates a transcritical refrigerant such as $CO_2$.

Refrigerant conduit subsystem 102 facilitates the movement of refrigerant (e.g., $CO_2$) through a refrigeration cycle such that the refrigerant flows in the refrigeration mode as illustrated by the arrows in FIG. 1. The refrigerant conduit subsystem 102 includes conduit, tubing, and the like that facilitates the movement of refrigerant between components of the refrigeration system 100. For clarity and conciseness, only a single conduit of the refrigerant conduit subsystem 102 is labeled in FIGS. 1 and 2 as refrigerant conduit subsystem 102. The refrigerant conduit subsystem 102 includes any conduit, tubing, and the like that is illustrated in FIGS. 1 and 2 connecting components of the refrigeration system 100.

Gas cooler 104 is generally operable to receive refrigerant (e.g., from MT compressor(s) 134 or oil separator 122) and apply a cooling stage to the received refrigerant. In some embodiments, gas cooler 104 is a heat exchanger comprising cooler tubes configured to circulate the received refrigerant and coils through which ambient air is forced. Inside gas cooler 104, the coils may absorb heat from the refrigerant, thereby cooling the refrigerant.

Figure 3A:
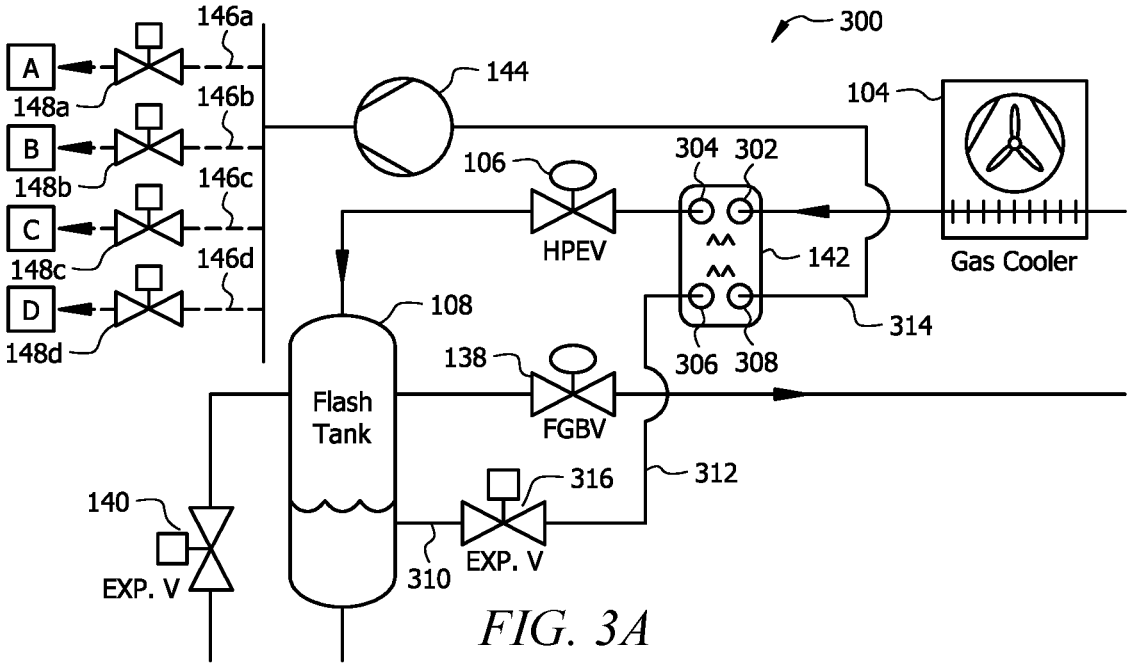
FIG. 3A is a diagram of a portion of the refrigeration system of FIG. 1, illustrating a first conduit configuration for providing refrigerant from the flash tank for defrosting one or more evaporators.
Figure 3B:
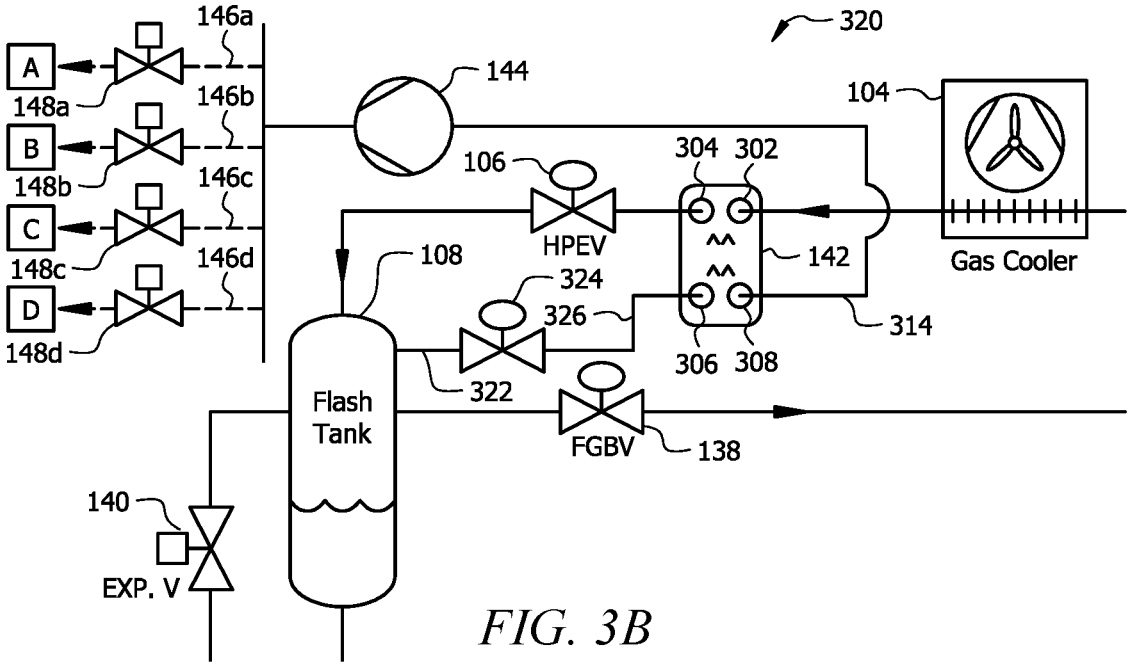
FIG. 3B is a diagram of a portion of the refrigeration system of FIG. 1, illustrating a second conduit configuration for providing refrigerant from the flash tank for defrosting one or more evaporators.
Figure 3C:
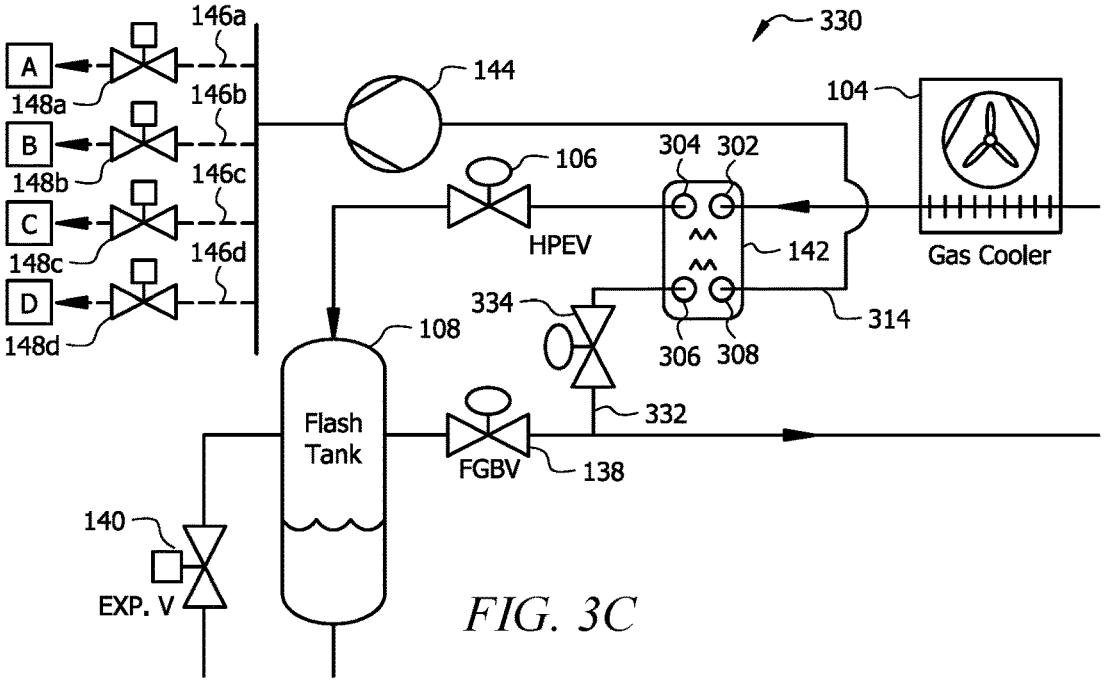
FIG. 3C is a diagram of a portion of the refrigeration system of FIG. 1, illustrating a third conduit configuration for providing refrigerant from the flash tank for defrosting one or more evaporators.

Heat exchanger 142 is located downstream of the gas cooler 104 and configured to receive cooled refrigerant from the gas cooler 104. When at least one of the evaporator units 110*a,b*, 124*a,b* is operating in defrost mode, as shown in FIG. 2, the defrost-mode compressor 144 turns on and causes the flow of refrigerant from the flash tank 108 into the heat exchanger 142. Accordingly, heat transfer occurs between the refrigerant from flash tank 108 and the cooled refrigerant from gas cooler 104. This heat transfer results in further cooling of the refrigerant from the gas cooler 104 and heating of the refrigerant from the flash tank 108. The heated refrigerant is compressed to high pressure and temperature and used to defrost evaporator(s) 116, 130 of any of the evaporator unit(s) 110*a,b*, 124*a,b* operating in defrost mode. In addition to providing heated refrigerant for defrosting evaporators 116, 130, heat exchanger 142 may provide supplemental cooling to refrigerant circulating through refrigeration system. Further details of the heat exchanger 142 and different possible fluid connections with flash tank 108 are illustrated in FIGS. 3A-C and described in the corresponding description below. When none of the evaporator units 110*a,b*, 124*a,b* are operating in defrost mode, as shown in FIG. 1, generally little or no heat transfer takes place in the heat exchanger 142 because the defrost-mode compressor 144 is turned off and there is no flow of refrigerant from the flash tank 108 to the heat exchanger 142.

Heat exchanger 142 discharges refrigerant, whether not further cooled as in FIG. 1 or further cooled as in FIG. 2, to expansion valve 106. Expansion valve 106 is configured to receive vapor refrigerant from heat exchanger 142 and reduce the pressure of the received refrigerant. In some embodiments, this reduction in pressure causes some of the refrigerant to vaporize. As a result, mixed-state refrigerant (e.g., refrigerant vapor and liquid refrigerant) may be discharged from expansion valve 106. In some embodiments, this mixed-state refrigerant is discharged to flash tank 108.

Flash tank 108 is configured to receive mixed-state refrigerant and separate the received refrigerant into flash gas and liquid refrigerant. Typically, the flash gas collects near the top of flash tank 108 and the liquid refrigerant is collected in the bottom of flash tank 108. In some embodiments, the liquid refrigerant flows from flash tank 108 and provides cooling to the MT evaporator units 110*a,b* and LT evaporator units 124*a,b*.

When operated in refrigeration mode (see FIG. 1), the MT evaporator units 110*a,b* receive cooled liquid refrigerant from the flash tank 108 and use the cooled refrigerant to provide cooling. Each of the MT evaporator units 110*a,b* includes an evaporator 116 along with appropriate valves 112, 114, 118 to facilitate operation of the MT evaporator units 110*a,b* in both a refrigeration mode (see FIG. 1) and a defrost mode (see FIG. 2). As an example, the evaporator 116 may be part of a refrigerated case and/or cooler for storing food and/or beverages that must be kept at particular temperatures. For clarity and conciseness, the components of a single MT evaporator unit 110*a* are illustrated. The refrigeration system 100 may include any appropriate number of MT evaporator units 110*a,b* with the same or a similar configuration to that shown for the example MT evaporator unit 110*a*.

When the MT evaporator unit 110*a* is operating in the refrigeration mode illustrated in FIG. 1, the first valve 112 upstream of the evaporator 116 is closed and the second valve 118 downstream of the evaporator 116 is open. In this configuration, the liquid refrigerant from flash tank 108 flows through expansion valve 114, where the pressure of the refrigerant is decreased, before it reaches the evaporator 116. Expansion valve 114 may be the same as or similar to expansion valve 106, described above. Expansion valve 114 may be configured to achieve a refrigerant temperature into the evaporator 116 at a predefined temperature (e.g., about −6° C.). The controller 170 may be in communication with valve 114 and control its operation (e.g., amount the valve 114 is open) to achieve the predefined temperature.

When the MT evaporator unit 110*a* is operating in the defrost mode illustrated in FIG. 2, the first valve 112 upstream of the evaporator 116 is open and the second valve 118 downstream of the evaporator 116 is closed. In this configuration, heated refrigerant from refrigerant conduit 146*b* flows through the evaporator 116 and defrosts the evaporator 116. Refrigerant exiting the evaporator 116 flows through the opened valve 112 and to expansion valve 140. Expansion valve 140 expands the refrigerant (i.e., decreases pressure of the refrigerant) before it flows back into the flash tank 108. Expansion valve 140 may be the same as or similar to expansion valves 106 and/or 114. In some embodiments, the MT evaporator unit 110*a* includes a pressure-activated valve 152 disposed in refrigerant conduit between the first valve 112 and the evaporator 116 that only allows refrigerant to flow after a threshold pressure has been reached. For example, the threshold pressure may be at least a predefined amount (e.g., 3 bar, 10 bar, or the like) greater than an internal pressure of the flash tank 108. This may ensure that a sufficient pressure is achieved to drive the flow of refrigerant from expansion valve 140 into the flash tank 108. A temperature and/or pressure sensor 156 may be disposed on, in, or near the evaporator 116 or refrigerant conduit connected to the evaporator 116. Information from sensor 156 may assist in determining when operation in defrost mode is appropriate or should be ended, as described further below.

Valves 112 and 118 may be in communication with controller 170, and the controller 170 may provide instructions for adjusting the valves 112, 118 to open or closed positions to achieve the configuration of FIG. 1 for refrigeration mode operation and the configuration of FIG. 2 for defrost mode operation. For example, instructions 178 implemented by the processor 172 of the controller 170 may determine that operation of the first evaporator unit 110*a* in a defrost mode is indicated. For example, instructions 178 stored by the controller 170 may indicate that defrost mode operation is needed on a certain schedule or at a certain time. As another example, a temperature of the evaporator 116 may indicate that defrost mode operation is needed (e.g., because the temperature indicates that expected cooling performance or efficiency is not being obtained). When defrost mode is indicated, the controller 170 turns on the defrost-mode compressor 144, opens first valve 112, and closes second valve 118 to obtain the defrost mode configuration illustrated in FIG. 2.

Once defrost mode operation is complete, the controller 170 may end defrost mode operation by turning off the defrost-mode compressor 144, closing first valve 112, and opening second valve 118 to return to the refrigeration mode configuration illustrated in FIG. 1. In some embodiments, the controller 170 may cause defrost mode to end after a predefined period of time included in the instructions 178. In some embodiments, the controller 170 may cause defrost mode operation to end after predefined conditions indicated in the instructions 178 are measured by the temperature and/or pressure sensor 156.

Refrigerant from the MT evaporator units 110*a,b* that are operating in refrigeration mode (i.e., MT evaporator units 110*a* and 110*b* in FIG. 1 and MT evaporator unit 110*b* in FIG. 2) is provided to the one or more MT compressors 120. The MT compressor(s) 120 are configured to compress refrigerant discharged from the MT evaporator units 110*a* and/or 110*b* and provide supplemental compression to refrigerant discharged from any of the LT evaporator units 124*a,b* that are operating in refrigeration mode (LT evaporator units 124*a,b* are described further below). Refrigeration system 100 may include any suitable number of MT compressors 120. MT compressor(s) 120 may vary by design and/or by capacity. For example, some compressor designs may be more energy efficient than other compressor designs, and some MT compressors 120 may have modular capacity (e.g., a capability to vary capacity). The controller 170 may be in communication with the MT compressors 120 and controls their operation.

LT evaporator units 124*a,b* are generally similar to the MT evaporator units 110*a,b* but configured to operate at lower temperatures (e.g., for deep freezing applications near about −30° C. or the like). When operated in refrigeration mode (see FIG. 1), the LT evaporator units 124*a,b* receive cooled liquid refrigerant from the flash tank 108 and use the cooled refrigerant to provide cooling. Each of the LT evaporator units 124*a,b* includes an evaporator 130 along with appropriate valves 126, 128, 132 to facilitate operation of the LT evaporator units 124*a,b* in both a refrigeration mode (see FIG. 1) and a defrost mode (see FIG. 2). As an example, the evaporator 130 may be part of a deep freezer for relatively long term storage of perishable that must be kept at particular temperatures. For clarity and conciseness, the components of a single LT evaporator unit 124*a* are illustrated. The refrigeration system 100 may include any appropriate number of LT evaporator units 124*a,b* with the same or a similar configuration to that shown for the LT evaporator unit 124*a*.

When the LT evaporator unit 124*a* is operating in the refrigeration mode illustrated in FIG. 1, the first valve 126 upstream of the evaporator 130 is closed and the second valve 132 downstream of the evaporator 130 is open. In this configuration, the liquid refrigerant from flash tank 108 flows through expansion valve 128, where the pressure of the refrigerant is decreased, before it reaches the evaporator 130. Expansion valve 128 may be the same as or similar to expansion valve 114, described above. Expansion valve 128 may be configured to achieve a refrigerant temperature into the evaporator 130 at a predefined temperature (e.g., about −30° C.). The controller 170 may be in communication with expansion valve 128 and control its operation (e.g., amount the valve 128 is open) to achieve the predefined temperature.

When the LT evaporator unit 124*a* is operating in the defrost mode illustrated in FIG. 2, the first valve 126 upstream of the evaporator 130 is open and the second valve 132 downstream of the evaporator 130 is closed. In this configuration, heated refrigerant from refrigerant conduit 146*a* flows through the evaporator 130 and defrosts the evaporator 130. Refrigerant exiting the evaporator 130 flows through the opened first valve 126 and to expansion valve 140. Expansion valve 140 expands the refrigerant (i.e., decreases pressure of the refrigerant) before it flows back into the flash tank 108. Expansion valve 140 may be the same as or similar to expansion valves 106 and/or 128. In some embodiments, the LT evaporator unit 124*a* includes a pressure-activated valve 154 disposed in refrigerant conduit between the first valve 126 and the evaporator 130 that only allows refrigerant to flow after a threshold pressure has been reached. For example, the threshold pressure may be at least a predefined amount (e.g., 3 bar, 10 bar, or the like) greater than an internal pressure of the flash tank 108. This may ensure that a sufficient pressure is achieved to drive the flow of refrigerant from expansion valve 140 into the flash tank 108. A temperature and/or pressure sensor 158 may be disposed on, in, or near the evaporator 130 or refrigerant conduit connected to the evaporator 130. Information from sensor 158 may assist in determining when operation in defrost mode is appropriate or should be ended, as described further below.

Valves 126 and 132 may be in communication with controller 170, and the controller 170 may provide instructions for adjusting the valves 126, 132 to open or closed positions to achieve the configuration of FIG. 1 for refrigeration mode operation and the configuration of FIG. 2 for defrost mode operation. For example, as described with respect to the MT evaporator unit 110*a* above, instructions 178 implemented by the processor 172 of the controller 170 may determine that operation of the first evaporator unit 124*a* in a defrost mode is indicated. For example, instructions 178 stored by the controller 170 may indicate that defrost mode operation is needed on a certain schedule or at a certain time. As another example, a temperature of the evaporator 130 may indicate that defrost mode operation is needed (e.g., because expected cooling performance or efficiency is not being obtained). When defrost mode operation is indicated, the controller 170 turns on the defrost-mode compressor 144, opens first valve 126, and closes second valve 132 to obtain the defrost mode configuration illustrated in FIG. 2.

Once defrost mode operation is complete, the controller 170 may end defrost mode operation by turning off the defrost-mode compressor 144, closing first valve 126, and opening second valve 132 to return to the refrigeration mode configuration illustrated in FIG. 1. In some embodiments, the controller 170 may cause defrost mode to end after a predefined period of time included in the instructions 178. In some embodiments, the controller 170 may cause defrost to mode to end after predefined conditions indicated in the instructions 178 are measured by the temperature and/or pressure sensor 158.

Refrigerant from the LT evaporator units 124*a,b* that are operating in refrigeration mode (i.e., LT evaporator units 124*a* and 124*b* in FIG. 1 and LT evaporator unit 124*b* in FIG. 2) is provided to the one or more LT compressors 134. The LT compressor(s) 134 are configured to compress refrigerant discharged from the LT evaporator units 124*a* and/or 124*b*. The compressed refrigerant from the LT compressors 134 is provided to the MT compressors 120 for supplemental compression. A pressure-relief valve 136 may be located on the discharge side of the LT compressors 134 and configured to open to decrease pressure if the pressure is greater than a threshold value (e.g., of about 585 psig). Refrigeration system 100 may include any suitable number of LT compressors 134. LT compressor(s) 134 may vary by design and/or by capacity. For example, some compressor designs may be more energy efficient than other compressor designs, and some LT compressors 134 may have modular capacity (e.g., a capability to vary capacity). The controller 170 may be in communication with the LT compressors 134 and controls their operation.

Flash gas bypass valve 138 may be located in refrigerant conduit connecting the flash tank 108 to the MT compressors 120 and configured to open and close to permit or restrict the flow of flash gas discharged from flash tank 108. In some embodiments, controller 170 controls the opening and closing of flash gas bypass valve 138. As depicted in FIGS. 1 and 2, closing flash gas bypass valve 138 may restrict flash gas from flowing to MT compressors 120 and opening flash gas bypass valve 138 may permit flow of flash gas to MT compressors 120.

The oil separator 122 may be located downstream the MT compressors 120. The oil separator 122 is operable to separate compressor lubrication oil from the refrigerant. The refrigerant is provided to the gas cooler 104, while the oil may be collected and returned to the MT compressors 120, as appropriate.

The defrost-mode compressor 144 is located downstream from the heat exchanger 142 and in fluid communication with the MT evaporator units 110*a,b* and LT evaporator units 124*a,b* via fluid conduits 146*a-d*. The defrost-mode compressor 144 is configured, when turned on, to compress refrigerant discharged from the heat exchanger 142. FIGS. 3A-C illustrate example connections of the defrost-mode compressor 144 to the heat exchanger 142 in greater detail. The compressed refrigerant from the defrost-mode compressor 144 is provided to any evaporator units 110*a,b*, 124*a,b* that are operating in defrost mode. The defrost-mode compressor 144 may include one or more compressors. In some embodiments, the defrost-mode compressor 144 is a higher capacity compressor than any of the MT compressors 120 and LT compressors 134 to facilitate further improved defrost mode performance. The defrost-mode compressor 144 may vary by design and/or by capacity. The controller 170 is in communication with the defrost-mode compressor 144 and controls its operation, for example, by causing it to turn on for operating at least one evaporator unit 110*a,b*, 124*a,b* in defrost mode, as illustrated in FIG. 2, and to turn off when all of the evaporator units 110*a,b*, 124*a,b* are operated in refrigeration mode, as illustrated in FIG. 1.

In some embodiments, each of the refrigerant conduits 146*a-d* includes a corresponding controllable valve 148*a-d* to adjust the flow of refrigerant through the corresponding conduit 146*a-d*. This may facilitate control of the distribution of refrigerant to two or more evaporator units 110*a,b*, 124*a,b* that are operated in defrost mode at the same time. Valves 148*a-d* may be in communication with and controlled by controller 170. A pressure-relief valve 150 may be in line with refrigerant conduits 146*a-d*, as illustrated in FIGS. 1 and 2. The pressure-relief valve 150 may open if a pressure of the refrigerant provided by the defrost-mode compressor 144 exceeds a threshold value (e.g., of about 696 psig).

As described above, controller 170 is in communication with at least the defrost-mode compressor 144, valves 112, 118 of the MT evaporator units 110*a,b*, and valves 126, 132 of the LT evaporator units 124*a,b*. The controller 170 adjusts operation of components of the refrigeration system 100 to operate the evaporator units 110*a,b*, 124*a,b* in refrigeration mode or defrost mode as appropriate. The controller includes a processor 172, memory 174, and input/output (I/O) interface 176. The processor 172 includes one or more processors operably coupled to the memory 174. The processor 172 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 174 and controls the operation of refrigeration system 100.

The processor 172 may be a programmable logic device, a microcontroller, a microprocessor, or any suitable combination of the preceding. The processor 172 is communicatively coupled to and in signal communication with the memory 174. The one or more processors are configured to process data and may be implemented in hardware or software. For example, the processor 172 may be 8-bit, 16-bit, 32-bit, 64-bit or of any other suitable architecture. The processor 172 may include an arithmetic logic unit (ALU) for performing arithmetic and logic operations, processor registers that supply operands to the ALU and store the results of ALU operations, and a control unit that fetches instructions from memory 174 and executes them by directing the coordinated operations of the ALU, registers, and other components. The processor 172 may include other hardware and software that operates to process information, control the refrigeration system 100, and perform any of the functions described herein (e.g., with respect to FIGS. 1-4). The processor 172 is not limited to a single processing device and may encompass multiple processing devices. Similarly, the controller 170 is not limited to a single controller but may encompass multiple controllers.

The memory 174 includes one or more disks, tape drives, or solid-state drives, and may be used as an over-flow data storage device, to store programs when such programs are selected for execution, and to store instructions and data that are read during program execution. The memory 174 may be volatile or non-volatile and may include ROM, RAM, ternary content-addressable memory (TCAM), dynamic random-access memory (DRAM), and static random-access memory (SRAM). The memory 174 is operable (e.g., or configured) to store information used by the controller 170 and/or any other logic and/or instructions for performing the function described in this disclosure. For example, the memory 174 may store instructions 178 for performing the functions of the controller 170 described in this disclosure. The instructions 178 may include, for example, a schedule for performing defrost mode operations, threshold temperature and/or pressure levels for determining when defrost is complete (e.g., based on information from sensors 156, 158 or other sensors of the refrigeration system 100), and the like.

The I/O interface 176 is configured to communicate data and signals with other devices. For example, the I/O interface 176 may be configured to communicate electrical signals with components of the refrigeration system 100 including the compressors 120, 134, 144, gas cooler 104, valves 106, 112, 114, 118, 126, 128, 132, 138, 140, 148*a-d*, evaporators 116, 130, and sensors 156, 158. The I/O interface 176 may be configured to communicate with other devices and systems. The I/O interface 176 may provide and/or receive, for example, compressor speed signals, compressor on/off signals, temperature signals, pressure signals, temperature setpoints, environmental conditions, and an operating mode status for the refrigeration system 100 and send electrical signals to the components of the refrigeration system 100. The I/O interface 176 may include ports or terminals for establishing signal communications between the controller 170 and other devices. The I/O interface 176 may be configured to enable wired and/or wireless communications.

Although this disclosure describes and depicts refrigeration system 100 including certain components, this disclosure recognizes that refrigeration system 100 may include any suitable components. As an example, refrigeration system 100 may include one or more additional sensors configured to detect temperature and/or pressure information. In some embodiments, each of the compressors 120, 134, 144, heat exchanger 142, gas cooler 104, flash tank 108, and evaporators 116, 130 include one or more sensors.

In an example operation of the refrigeration system 100, the refrigeration system 100 is initially operating with all evaporator units 110*a,b*, 124*a,b* in the refrigeration mode, as illustrated in FIG. 1. In this mode, the defrost-mode compressor 144 is turned off. All of the MT evaporator units 110*a,b* are configured as shown for MT evaporator 110*a* in FIG. 1 (i.e., with first valve 112 closed and second valve 118 open), and all of the LT evaporator units 124*a,b* are configured as shown for LT evaporator 124*a* in FIG. 1 (i.e., with first valve 126 closed and second valve 132 open).

At some point during operation of the refrigeration system 100, the controller 170 determines that defrost mode operation is needed for the first MT evaporator unit 110*a* and the first LT evaporator unit 124*a*. For example, the first MT evaporator unit 110*a* and the first LT evaporator unit 124*a* may be scheduled for defrost at the same time that has just been reached. After determining that the defrost mode operation is indicated, the controller 170 causes the first MT evaporator 110*a* and the first LT evaporator 124*a* to be configured according to FIG. 2. In other words, the controller 170 causes first valves 112, 126 to open and second valves 118, 132 to close. The controller 170 also causes the defrost-mode compressor 144 to turn on.

With the defrost-mode compressor 144 turned on, a portion of refrigerant from flash tank 108 is provided to the heat exchanger 142. Heat transfer between this portion of refrigerant and the refrigerant from gas cooler 104 causes the portion of refrigerant from the flash tank 108 to increase in temperature. Meanwhile, the refrigerant from the gas cooler is further cooled, providing improved refrigeration performance for the other evaporator units 110*b*, 124*b* that are still operating in the refrigeration mode.

The heated refrigerant from the heat exchanger 142 is compressed by compressor 144 and provided to the evaporator units 110*a*, 124*a*, as illustrated in FIG. 2. For example, compressed heated refrigerant is provided via refrigerant conduit 146*a* to the evaporator 130 and via refrigerant conduit 146*b* to the evaporator 116. The heated refrigerant is allowed to flow through the evaporators 116, 130 to defrost the evaporators 116, 130. Defrost operation may proceed for a predefined period of time. After this period of time, the evaporator units 110*a*, 124*a* may be returned to operating in refrigeration mode, as shown in FIG. 1. In other words, the controller 170 causes first valves 112, 126 to close and second valves 118, 132 to open. The controller 170 also causes the defrost-mode compressor 144 to turn off, as long as defrost mode operation is not ongoing in any other evaporator unit 110*b*, 124*b*.

Example Heat Exchanger and Defrost-Mode Compressor Configurations

FIGS. 3A-C show different possible configurations of a subset of the components of the refrigeration system 100 illustrated in FIGS. 1 and 2. FIG. 3A shows a first configuration 300. As shown in FIG. 3A, the heat exchanger 142 includes a first inlet 302 that receives refrigerant from the gas cooler 104 and a first outlet 304 the provides refrigerant to the expansion valve 106. As described above with respect to FIGS. 1 and 2, when at least one evaporator unit 110*a,b* 124*a,b* is operated in defrost mode, the defrost-mode compressor 144 is turned on and the heat exchanger 142 further cools refrigerant received from the gas cooler 104. In configuration 300, during defrost mode operation, a portion of liquid refrigerant from flash tank 108 is provided via conduit 310 to a defrost-mode expansion valve 316. The defrost-mode expansion valve 316 expands the liquid refrigerant (e.g., to obtain a gas or gas-liquid mixture of refrigerant). This expanded (e.g., depressurized) refrigerant is provided via conduit 312 to a second inlet 306 of the heat exchanger 142. The refrigerant received at second inlet 306 absorbs heat from the refrigerant from the gas cooler 104 (received at first inlet 302) and exits the heat exchanger 142 from second outlet 308 at an elevated temperature (e.g., with a superheat of 20 K or more). This heated refrigerant is provided via conduit 314 to the defrost-mode compressor 144, which compresses the heated refrigerant and provides the refrigerant via refrigerant conduit 146*a-d* to defrost the evaporator 116, 130 that is to be defrosted.

FIG. 3B shows an alternate configuration 320 in which a portion of the flash gas from the flash tank 108 is provided to the second inlet 306 of the heat exchanger 142. In this configuration 320, a refrigerant conduit 322 is connected to the flash tank 108 (e.g., to an outlet associated with vapor refrigerant stored in the flash tank 108). A valve 324 is used to adjust the amount of flash gas that is provided to the heat exchanger 142. Conduit 326 connects the valve 324 to the heat exchanger 142. The valve 324 may be in communication with and controlled by the controller 170. The flash gas then flows via conduit 326 to the second inlet 306 of the heat exchanger 142. The other components behave as described above with respect to FIG. 3A.

FIG. 3C shows another alternate configuration 330 in which a portion of the bypassed flash gas is diverted to the second inlet 306 of the heat exchanger 142. In this configuration 330, a refrigerant conduit 332 is connected downstream from bypass valve 138. A valve 334 is used to adjust the amount of bypassed flash gas that is provided to the heat exchanger 142. The valve 334 may be in communication with and controlled by the controller 170. The flash gas then flows to the second inlet 306 of the heat exchanger 142. The other components behave as described above with respect to FIG. 3A.

Example Method of Operation

Figure 4:
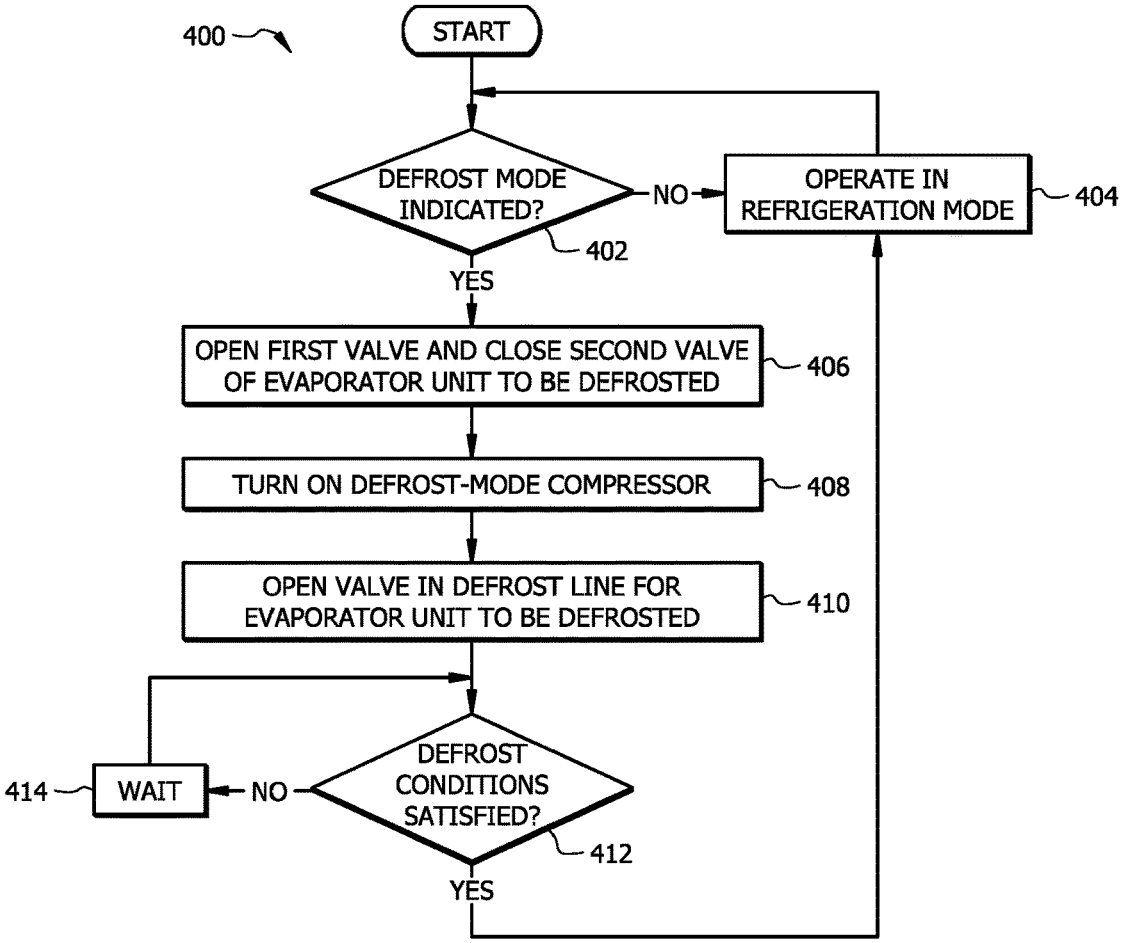
FIG. 4 is a flowchart of an example method of operating the refrigeration system of FIGS. 1 and 2 to provide improved evaporator defrost.

FIG. 4 illustrates a method 400 of operating the refrigeration system 100 described above with respect to FIGS. 1, 2, and 3A-C. The method 400 may be implemented using the processor 172, memory 174, and I/O interface 176 of the controller 170 of FIGS. 1 and 2. The method 400 may begin at step 402 where the controller 170 determines whether defrost mode is indicated for any of the evaporator units 110*a,b*, 124*a,b*. For example, the controller 170 may determine whether the instructions 178 indicate that a defrost cycle is scheduled for one of the evaporator units 110*a,b*, 124*a,b*. As another example, the controller 170 may determine whether a temperature measured at an evaporator 116, 130 indicates decreased performance (e.g., if a target temperature is not being reached). This behavior may indicate that a defrost mode operation is indicated. If defrost mode is not indicated, the controller 170 proceeds to step 404 and operates the evaporator units 110*a,b*, 124*a,b* in the refrigeration mode. If defrost mode operation is indicated, the controller 170 may proceed to step 406.

At step 406, the controller 170 causes the first valve 112, 126 to open and the second valve 118, 132 to close in the evaporator unit 110*a,b*, 124*a,b* for which defrost mode operation was indicated at step 402. This achieves the defrost mode configuration illustrated in FIG. 2. In a refrigeration system 100 with the configuration 330 of FIGS. 3B and 3C, the controller 170 may also open valve 334 to allow flash gas to flow to the heat exchanger 142 (see FIGS. 3B and 3C).

At step 408, the controller 170 turns on the defrost-mode compressor 144. After being turned on, the defrost-mode compressor causes a portion of refrigerant from the flash tank 108 to flow to the heat exchanger 142 (e.g., to the second inlet 306 shown in FIGS. 3A-C). This portion of refrigerant is heated via heat transfer with refrigerant provided by the gas cooler 104. The resulting heated refrigerant compressed by the defrost mode compressor and provided to the evaporator unit 110*a,b*, 124*a,b* for which defrost operation was indicated at step 402. In some cases (e.g., where defrost mode operation is indicated for multiple evaporator units 10*a,b*, 124*a,b*), the controller 170, at step 410, may adjust valves 148*a-d* to control flow of heated refrigerant to the evaporator units 110*a,b*, 124*a,b* for which defrost operation was indicated at step 402. This may facilitate improved control over the defrost process (e.g., if a greater flow rate of refrigerant is needed for one evaporator type than another).

At step 412, the controller 170 determines whether defrost conditions are satisfied for ending defrost mode operation. The defrost conditions may be indicated by the instructions 178 stored in the memory 174 of the controller 170. For example, the defrost conditions may indicate that defrost mode operation must be performed for a predefined period of time. As another example, the defrost conditions may indicate that an output temperature at or near the positions of sensor 156, 158 must increase to at least a predefined temperature (e.g., of about 11° C.) before defrost mode operation is complete. If the defrost conditions are not met, the controller 170 proceeds to step 414 to wait a period of time before returning to step 412.

If the defrost conditions of step 412 are satisfied, the controller 170 proceeds to step 404 and returns to operating in the refrigeration mode. In order to operate in the refrigeration mode at step 404, the controller 170 may cause the first valve 112, 126 to close and the second valve 118, 132 to open. If no other evaporator unit 110*a,b*, 124*a,b* is operating in the defrost mode, the defrost-mode compressor 144 is turned off.

Modifications, additions, or omissions may be made to method 400 depicted in FIG. 4. Method 400 may include more, fewer, or other steps. For example, steps may be performed in parallel or in any suitable order. While at times discussed as controller 170, refrigeration system 100, or components thereof performing the steps, any suitable refrigeration system or components of the refrigeration system may perform one or more steps of the method 400.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, comprising a gas cooler, a heat exchanger located downstream from the gas cooler, a flash tank located downstream a first outlet of the heat exchanger, a defrost-mode compressor located downstream a second outlet of the heat exchanger, a first evaporator unit located downstream from the flash tank, and a controller communicatively coupled to the defrost-mode compressor, wherein:

the flash tank is configured to store refrigerant;

the gas cooler is configured to receive refrigerant and facilitate heat transfer from the received refrigerant, thereby cooling the refrigerant;

the controller is configured to:

determine that operation of the first evaporator unit in a defrost mode is indicated; and after determining that operation of the first evaporator unit in the defrost mode is indicated, cause the first evaporator unit to operate in the defrost mode, wherein causing the first evaporator unit to operate in the defrost mode comprises causing the defrost-mode compressor to turn on;

the heat exchanger is configured, while the defrost-mode compressor is turned on, to:

receive a portion of refrigerant stored by the flash tank; and transfer heat from the received portion of refrigerant to the refrigerant cooled by the gas cooler, thereby heating the received portion of refrigerant; and cause the defrost-mode compressor to turn off after causing the first evaporator unit to operate in the defrost mode for a predefined period of time; and the defrost-mode compressor is configured, while turned on, to provide the portion of the refrigerant heated by the heat exchanger to the first evaporator unit, thereby defrosting an evaporator of the first evaporator unit.

2. The refrigeration system of claim 1, further comprising an expansion valve configured to:

receive the portion of refrigerant from the flash tank, wherein the portion of refrigerant from the flash tank comprises liquid-phase refrigerant;

decrease a pressure of the portion of refrigerant, and provide the portion of depressurized refrigerant to the heat exchanger.

3. The refrigeration system of claim 1, further comprising a refrigerant conduit configured to allow a flow of the portion of refrigerant from the flash tank to the heat exchanger, wherein the portion of refrigerant comprises vapor refrigerant.

4. The refrigeration system of claim 1, further comprising a bypass valve configured to:

receive the portion of refrigerant from the flash tank, wherein the portion of refrigerant from the flash tank comprises vapor refrigerant; and provide the portion of refrigerant to the heat exchanger.

5. The refrigeration system of claim 1, further comprising a second evaporator unit located downstream from the flash tank, wherein, while the first evaporator unit is caused to operate in the defrost mode, the second evaporator unit is caused to operate in a refrigeration mode.

6. The refrigeration system of claim 1, further comprising a pressure-relief valve configured to open if a pressure of the portion of the refrigerant provided by the defrost-mode compressor exceeds a threshold value.

7. The refrigeration system of claim 1, wherein:

the first evaporator unit comprises:

a first valve located upstream from the evaporator, wherein, when the first evaporator unit is operating in a refrigeration mode, the first valve is closed; and a second valve located downstream from the evaporator, wherein, when the first evaporator unit is operating in the refrigeration mode, the second valve is open; and the controller is further configured to cause the first evaporator unit to operate in the defrost mode by causing the first valve to open and causing the second valve to close.

8. The refrigeration system of claim 7, wherein the first evaporator unit further comprises a pressure-activated valve disposed in a refrigerant conduit between the first valve and the evaporator, the pressure-activated valve configured to allow flow of refrigerant after a threshold pressure is reached, wherein the threshold pressure is greater than a pressure of the flash tank.

9. A method of operating a refrigeration system, the method comprising:

determining that operation of a first evaporator unit of the refrigeration system in a defrost mode is indicated; and after determining that operation of the first evaporator unit in the defrost mode is indicated:

causing a first valve of the first evaporator unit to open;

causing a second valve of the first evaporator unit to close; and causing a defrost-mode compressor of the refrigeration system to turn on, such that a portion of refrigerant stored by a flash tank of the refrigeration system is provided to and heated by a heat exchanger and the resulting heated portion of the refrigerant is provided to the first evaporator unit, thereby defrosting an evaporator of the first evaporator unit; and after a predefined period of time following causing the defrost-mode compressor to turn on, causing the defrost-mode compressor to turn off.

10. The method of claim 9, further comprising, while the first evaporator unit is caused to operate in the defrost mode, causing a second evaporator unit to operate in a refrigeration mode.

11. The method of claim 9, further comprising, after the predefined period of time following causing the defrost-mode compressor to turn on:

causing the first valve of the first evaporator unit to close; and causing the second valve of the first evaporator unit to open.

12. A refrigeration system, comprising a gas cooler, a heat exchanger located downstream from the gas cooler, a flash tank located downstream a first outlet of the heat exchanger, a defrost-mode compressor located downstream a second outlet of the heat exchanger, and a first evaporator unit located downstream from the flash tank, wherein:

the flash tank is configured to store refrigerant;

the gas cooler is configured to receive refrigerant and facilitate heat transfer from the received refrigerant, thereby cooling the refrigerant;

the defrost-mode compressor is configured to turn on when defrost mode of the first evaporator unit is indicated;

the heat exchanger is configured, while the defrost-mode compressor is turned on, to:

receive a portion of refrigerant stored by the flash tank; and transfer heat from the received portion of refrigerant to the refrigerant cooled by the gas cooler, thereby heating the received portion of refrigerant; and the defrost-mode compressor is further configured, when turned on, to provide the portion of the refrigerant heated by the heat exchanger to the first evaporator unit, thereby defrosting an evaporator of the first evaporator unit; and the defrost-mode compressor is configured to turn off after causing the first evaporator unit to operate in the defrost mode for a predefined period of time.

13. The refrigeration system of claim 12, further comprising an expansion valve configured to:

receive the portion of refrigerant from the flash tank, wherein the portion of refrigerant received from the flash tank comprises liquid-phase refrigerant;

decrease a pressure of the portion of refrigerant, and provide the portion of depressurized refrigerant to the heat exchanger.

14. The refrigeration system of claim 12, further comprising a refrigerant conduit configured to allow a flow of the portion of refrigerant from the flash tank to the heat exchanger, wherein the portion of refrigerant comprises vapor refrigerant.

15. The refrigeration system of claim 12, further comprising a bypass valve configured to:

receive the portion of refrigerant from the flash tank, wherein the portion of refrigerant from the flash tank comprises vapor refrigerant; and provide the portion of refrigerant to the heat exchanger.

16. The refrigeration system of claim 12, further comprising a pressure-relief valve configured to open if a pressure of the portion of the refrigerant provided by the defrost-mode compressor exceeds a threshold value.

17. The refrigeration system of claim 12, wherein:

the first evaporator unit comprises:

a first valve located upstream from the evaporator, wherein the first valve is closed when the first evaporator unit is operating in a refrigeration mode, and the first valve is open when the first evaporator unit is operating in the defrost mode; and a second valve located downstream from the evaporator, wherein the second valve is open when the first evaporator unit is operating in the refrigeration mode and the second valve is closed when the first evaporator unit is operating in the defrost mode.

18. The refrigeration system of claim 17, wherein the first evaporator unit further comprises a pressure-activated valve disposed in a refrigerant conduit between the first valve and the evaporator, the pressure-activated valve configured to allow flow of refrigerant after a threshold pressure is reached, wherein the threshold pressure is greater than a pressure of the flash tank.

* * * * *